United States Patent [19]

Ham

[11] 4,164,647

[45] Aug. 14, 1979

[54] UNIDIRECTIONAL REGISTER HAVING DIFFERENT GEAR RATIOS FOR NORMAL AND REVERSE INPUT DRIVE ROTATION

[75] Inventor: Donald M. Ham, Rochester, N.H.

[73] Assignee: General Electric Company, Somersworth, N.H.

[21] Appl. No.: 877,244

[22] Filed: Feb. 13, 1978

[51] Int. Cl.[2] ..... G06M 1/00

[52] U.S. Cl. ..... 235/91 R; 235/95 R; 235/144 MA; 324/103 R

[58] Field of Search ..... 235/91 R, 144 MA, 95 R, 235/1 C; 324/103 R

[56] References Cited

U.S. PATENT DOCUMENTS

| | | | |
|---|---|---|---|
| 3,364,769 | 1/1968 | Etherton, Sr. | 235/95 R |
| 3,981,439 | 9/1976 | Ham | 235/91 R |

*Primary Examiner*—Stephen J. Tomsky

*Attorney, Agent, or Firm*—Robert E. Brunson; Francis X. Doyle

[57] ABSTRACT

A unidirectional drive assembly for a mechanically driven meter register includes a gear shift operated gear ratio mechanism which allows a dial on the meter register to be driven up-scale at a normal rate with the forward direction of rotation of the meter input drive and driven up-scale at a compensated or faster rate with the reverse direction of rotation of the meter input drive. The ratio of the gears of the gear ratio mechanism can easily be changed to provide ratios which compensate for meter drag when the meter is run in the inverted position so that the meter registers correctly when operated in either the upright or inverted position, or to provide ratios which make the meter dial run up-scale at a faster than normal rate when the meter is tampered with to make its input drive operate in the reverse direction of rotation.

5 Claims, 5 Drawing Figures

UNIDIRECTIONAL REGISTER HAVING DIFFERENT GEAR RATIOS FOR NORMAL AND REVERSE INPUT DRIVE ROTATION

BACKGROUND OF THE INVENTION

The present invention relates to a unidirectional drive assembly of the type which is operable to rotate an output drive assembly in a single direction regardless of the forward or reverse direction of rotation of an input gear drive assembly. More particularly, the invention relates to a unidirectional drive assembly that is suitably adaptable for use in driving a mechanical watthour meter register which provides a reliable compact assembly, having highly accurate operational throughput with low manufacturing cost.

Unidirectional registers of various types have been in use for years to record power measured by electric watthour meters. These meters were initially developed to prevent attempts to defraud the utility companies by such abusive actions which might cause the meters to register an improperly low rate of power consumption. It is generally well known that a conventional induction type watthour meter can be made to rotate in a reverse direction merely by reversing the potential applied to the meter. In a conventional meter, the simplest way to perform this reversal is to simply remove the meter from its socket and re-insert it in the socket upside down. This will cause the meter to rotate in its reverse direction, causing the meter register to run down scale rather than up-scale, thus decreasing the amount of power normally registered. To prevent such misuse of registers, and a consequent economic loss to utility companies, unidirectional registers were developed which cause the meter register indicators to rotate in an up-scale direction regardless of the forward or reverse direction of rotation of the meter input gear drive assembly.

One known type of meter to prevent the aforementioned attempt to defraud the utility company utilizes a detent assembly which prevents the meter movement from rotating in the reverse direction. While this detent prevents down-scale operation of the register when the meter is inverted, the detent does not permit the meter to provide the normal billing indications.

In U.S. Pat. No. 4,039,943, issued Aug. 2, 1977, an anti-tampering watthour meter is disclosed which includes liquid contact switches which are connected between the meter voltage coil winding ends and the terminal blades of the meter. When the meter is in the inverted position, the liquid contact switches cause the voltage coil winding ends to be reversely connected between the pair of terminal blades, thus causing the meter to continue rotation in the normal direction. This patent also discloses a penalty metering arrangement in combination with the voltage reversing arrangement, which magnetically shunts the permanent magnet field of the meter damping magnet away from the watthour meter disc so that the disc is rotated at increased speed when the meter is inverted. It may be difficult however, to control the rate at which the disc rotates, and thus the rate at which the meter register is driven.

Another known anti-tampering unidirectional register in which the present invention finds use, is disclosed in U.S. Pat. No. 3,981,439, entitled "Unidirectional Drive Assembly For Gear Driven Meter Register," to Donald M. Ham and assigned to the Assignee of the present invention. In that patent, a simple low cost mechanical unidirectional drive assembly is characterized by a gear shift assembly which co-operates with an input gear assembly to drive a register indicator dial up-scale at the same rate, via an idler-gear arrangement, regardless of the direction of rotation of the meter input gear assembly.

While some of the above mentioned registers provide means to always drive the meter register up-scale and, as disclosed in U.S. Pat. No. 4,039,943, the abusive meter user may be penalized by making the meter run at a faster rate when the meter is inverted, they do not disclose a simple and economic mechanical means for accurately performing both of those functions.

It is also known in the art, that some meters, when run in the inverted position, tend to run slower than when in their normal position due to various frictional forces, such as bearing drag. Thus, unless a calibrated compensation is made for this slowdown, the utilities are still defrauded of revenues. Therefore, a need exists for a simple low cost unidirectional drive assembly capable of accurately operating a meter register to continuously read up-scale regardless of the direction of meter drive rotation and regardless of how slow the meter may tend to run in the inverted position. Further, the same need exists for such a unidirectional drive assembly which can be fabricated to penalize those who attempt to defraud the utility company in the aforedescribed manner.

It is therefore an object of the invention to provide a unidirectional drive assembly having enhanced operating capabilities.

Another object is to provide a simple low cost design unidirectional meter register drive assembly easily adaptable to operate the meter register at calibrated rates which compensate for slow down of the meter when it is in various operating positions.

A further object of the invention is to provide a unidirectional meter register with a gear shifting and calibrated gear ratio mechanism to overcome meter drag which allows the register dials to rotate in the same direction at the same rate regardless of the direction of rotation of input drive to the register and regardless of the amount of drag created by frictional forces within the meter.

Still another object is to provide an improved unidirectional drive assembly for a gear driven meter register which provides the capability of easily changing gear ratios to allow the meter register to run at one rate when the meter is driven in a forward direction and run at a faster or compensated rate when the meter is run in a reverse direction.

Additional objects and advantages of the invention will become apparent from the description which follows.

SUMMARY OF THE INVENTION

In a preferred form of the invention, a unidirectional drive assembly for a gear driven meter register is provided with an input gear assembly which can be driven in either of forward or reverse directions. A gear shift assembly, having forward and reverse idler pinions mounted thereon is coaxially mounted in rotatable contact with the input gear assembly while the pinions maintain constant meshing engagement with a gear on the input gear assembly. A register drive gear assembly is connected to a dial or register pointer indicator and includes first and second indicator drive gears. An idler gear assembly contains first and second idler gears, with the second idler gear being in continuous meshing engagement with the second drive gear to form a calibrated gear ratio mechanism which allows compensation for meter drag slow down or allows the register dials to be driven at faster than normal rate with reverse rotation of the input gear assembly.

The first idler gear and the first register drive gear are mounted adjacent the idler pinions of the gear shift assembly. The gear shift assembly is pivotal in response to rotation, in a first or forward direction of the meter input gear assembly, to cause the first idler pinion to come into meshing engagement with the first drive gear to drive the register dials up-scale at a first rate determined by the ratio of the input gear assembly and the first drive gear. When the input gear assembly is driven in a second or reverse direction, the gear shift assembly is effective to cause the second pinion to come into meshing engagement with the first idler gear to now drive the register dials up-scale, via the idler assembly gears and the second drive gear, at a second rate determined primarily by the ratio of the second idler gear and the second drive gear.

BRIEF DESCRIPTION OF THE DRAWING

While this specification terminates with claims specifically defining and setting forth what is considered to be the present invention, a clearer understanding thereof may be had from the following description taken in conjunction with the accompanying drawing in which:

DESCRIPTION OF A PREFERRED EMBODIMENT

Figure 1:
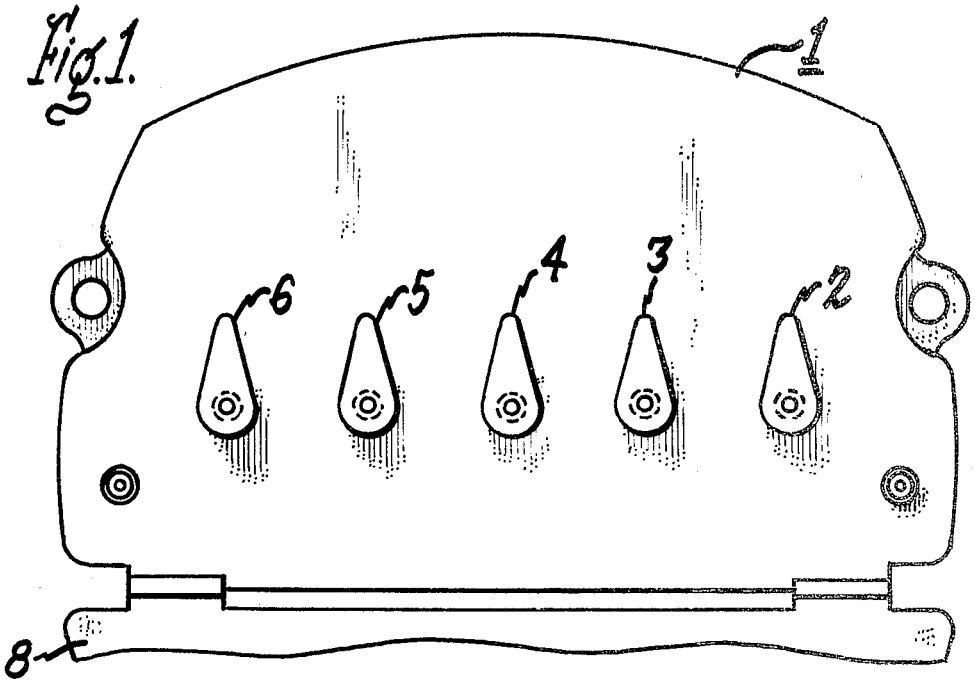
FIG. 1 is a front plan view of a unidirectional meter register shown mounted on a fragment of a conventional watthour meter face plate assembly. The illustrated unidirectional register dial pointers or indicators are coupled by a conventional drive train to a unidirectional drive assembly constructed in accordance with the present invention.
Figure 2:
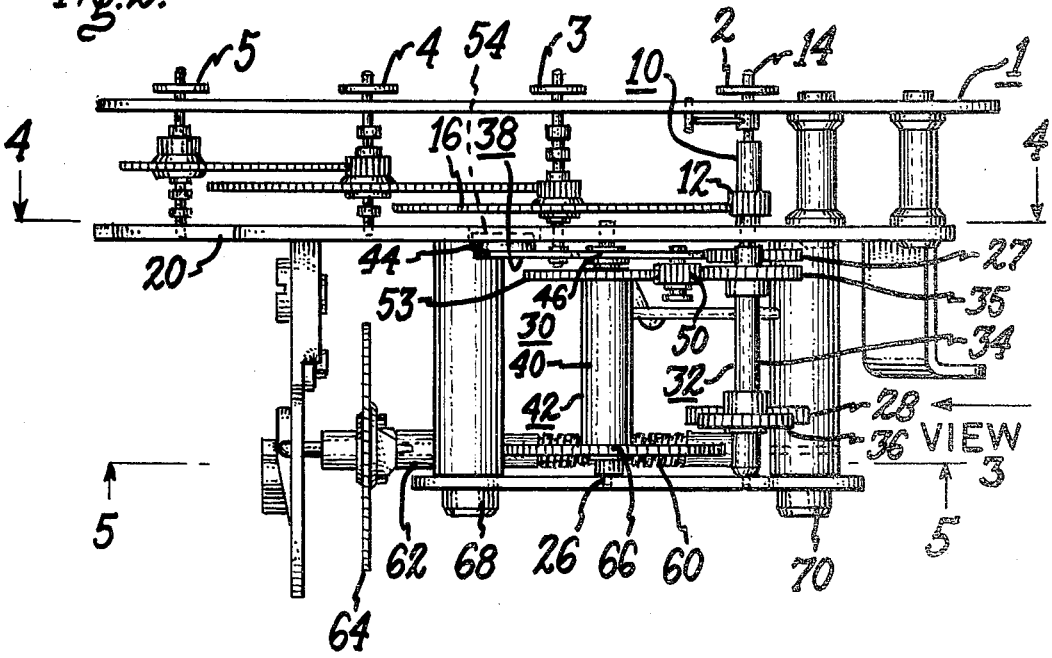
FIG. 2 is a bottom elevation view of the register shown in FIG. 1 illustrating the improved unidirectional drive assembly of the present invention in association with a conventional watthour meter register input drive gear mounted in driving relationship with the unidirectional meter register input gear assembly.

With reference now to FIG. 1, there is shown a relatively conventional watthour meter register plate 1 having rotatably mounted register indicator pointer dials 2, 3, 4, 5 and 6. These register indicator dials are coupled together in driving relationship by a conventional gear train as illustrated by FIG. 2. The register face plate 1 is shown mounted above a portion of a conventional watthour meter front plate 8.

The present invention is a technological extension of the unidirectional drive assembly art and is an improvement of the unidirectional drive assembly disclosed in the afore-mentioned U.S. Pat. No. 3,981,439. In that patent a detailed structural and operational description is given of the register gear train and of the unidirectional drive assembly of that invention. For that reason, only those portions of FIG. 2, as they relate to a complete understanding of the present invention, will be described in detail, with specific reference being made to the U.S. Pat. No. 3,981,439 as an essential reference for those details not described herein.

In FIG. 2, an indicator dial gear drive assembly 10 comprises a drive pinion 12 fixed to a shaft 14 on which the first pointer 2 is staked in any conventional manner. The drive pinion 12 is in meshing engagement with a dial drive gear 16 for driving that gear and the other register dial gears in the manner described in the aforementioned referenced patent. The shaft 14 extends through a suitable opening 18 cut out of center supporting member or plate 20 and is journaled to rotate in suitable apertures or bearings formed in the plate 1 and a rear support member 26 (See FIGS. 2 and 4).

Figure 5:
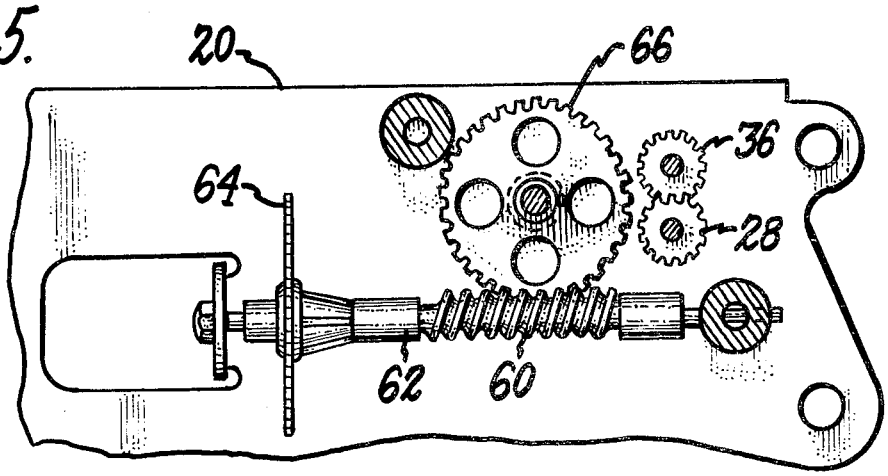
FIG. 5 is a rear view of the unidirectional drive assembly illustrated in FIG. 2, with supporting member removed, and taken along the plane 5—5 shown therein. Illustrated is the meshing engagement of the second idler gear and the second drive gear of the ratio gear assembly for driving the register dials up-scale at a compensated or faster rate when the second pinion of the gear shift assembly is in engagement with the first idler gear of the idler gear assembly.

Still referring to FIG. 2, the dial gear drive assembly 10 also includes fist and second drive gears 27 and 28 fixed to shaft 14 which rotate with that shaft. In addition to the dial drive assembly, the unidirectional drive assembly 30 of the present invention also includes an idler gear assembly 32 comprised of an idler shaft 34 having first and second idler gears 35 and 36 fixed thereto. As shown in FIGS. 2 and 5, the second idler gear 36 and the second drive gear 28 are in constant meshing engagement whereby the dial drive shaft 14 is driven with rotation of the idler shaft 34 (see FIG. 3). Likewise, if the dial drive shaft 14 is being driven, the idler shaft 34 will rotate via the engagement of gears 28 and 36. The purpose of these latter gears and their relationship in the operation of the invention will subsequently be described.

Figure 3:
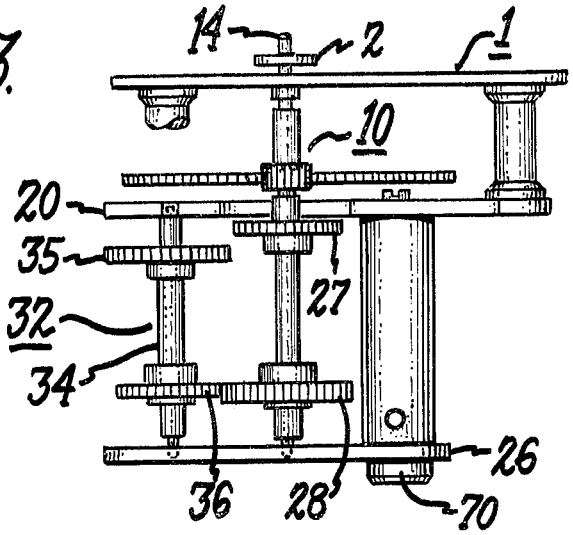
FIG. 3 is a side elevation view of the unidirectional drive assembly of the present invention taken along line 3, as shown in FIG. 2, and illustrates primarily the relationship between the idler and indicator gear drive assemblies.
Figure 4:
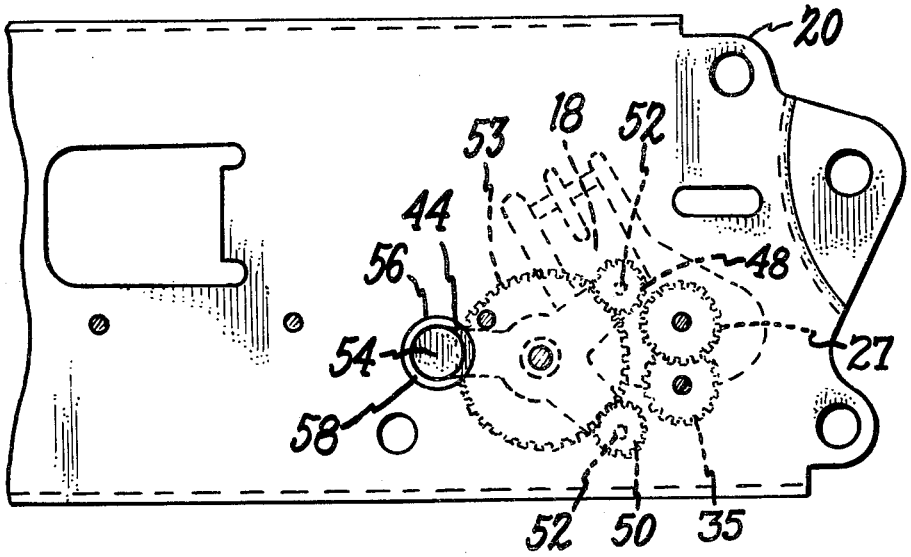
FIG. 4 is a fragmentary top plan view of the front side of the intermediate frame plate of the frame assembly used in the unidirectional drive assembly illustrated in FIG. 2, taken along the plane 4—4 shown therein, and shown with respect to an illustration in phantom of a first register indicator drive gear and a first idler gear and illustrating the meshing engagement relationship between the first and second idler pinions of the gear shift assembly and the first idler gear and the first indicator drive gear respectively.

As can also be seen in FIGS. 2 and 4, an important characteristic of the invention is the inclusion of an idler gear shift assembly 38 designed to be in frictional engagement by being nested within a hollow shaft 40 of an input gear drive assembly 42. For the structural and operational details of this nesting relationship of the gear shift and input gear drive assemblies reference is made to FIGS. 3*a* and 3*b* of the U.S. Pat. No. 3,981,439. As described in that patent, and as partially shown by FIGS. 2 and 4, the gear shift assembly 38 consists of a rotatable solid shaft having cylindrical bearing surfaces substantially on each end. A shift plate 44 is solidly affixed to one end of the solid shaft at 46. First and second idler pinions (gears) 48 and 50 (See FIGS. 2 and 4) are rotatably mounted on axles 52 on the shift plate 44. The axles are arranged on one side of the shift plate and positioned so that the pinions 48 and 50 are spaced an equal distance from the axis of rotation of the shift plate shaft and the center of hollow shaft 40. Also, as shown in FIG. 4, the pinions are in continuous meshing engagement with an input gear 53 fixed to shaft 40. The gear shift plate is preferably Y-shaped having the pinions 48 and 50 mounted adjacent the outer ends of the forked legs of the Y-shaped plate and having a stop member 54 mounted adjacent the outer end of the third or trunk leg of the Y-shaped plate. As described in the aforementioned patent, the stop member 54 serves to statically balance the gear shift assembly relative to a plane through the legs of the Y-shaped shift plate as well as arresting or limiting the distance of arcuate travel of the shift plate and pinions 48 and 50 by the stop member 54 coming into contact with two limit stops 56 and 58 formed by an aperture in the support member 20 (See FIG. 4).

From a functional standpoint, the frictional forces between the outer surfaces of the hollow shaft 40, combined with the frictional forces of the bearing surfaces on the gear shift assembly solid shaft, cause the fixed shaft to rotate with the hollow shaft, thereby causing the shift plate 44 to rotate with the input gear assembly 42 until movement of the shift plate is arrested either by the stop member 54 contacting one of the limit stops 56 or 58, or by either of the pinions 48 or 50 coming into engagement with their respectively associated first drive gear 27, or first idler gear 35 (See FIG. 4).

As described in the afore referenced patent, the input gear drive assembly is driven via a worm gear 60 on a shaft 62 having an input ring gear 64 fixed to one end thereof which meshes in any well known manner with a suitable watthour meter gear arranged to be coupled with a rotatable induction disc of a watthour meter. Briefly, when gear 64 rotates, it causes rotation of the input gear assembly 42 via worm gear 60, which is in meshing engagement with a wheel gear 66 on one end of hollow shaft 40. As shaft 40 rotates, the frictional or clutch forces between shaft 40 and the solid shaft of the gear shift assembly 38 cause the shift plate 44 to rotate with the input gear assembly until one of the pinions (depending upon the direction of rotation) comes into engagement with its respective gear on either the idler assembly or the dial drive assembly. Once the pinion is engaged and all pivotal movement of the gear shift has been stopped, the input drive gear 53 continues to rotate transferring that rotation via the engaged pinion to that pinion's respectively engaged gear.

To now understand how the invention can be made to drive the indicator dials up-scale at one rate (normal rate) with forward rotation of the meter and up-scale at either a compensated or higher rate for reverse rotation of the meter, reference is made to FIGS. 2, 3, 4 and 5. A perspective relationship between the idler and indicator gear assemblies can be seen by FIG. 3 taken along the view 3 line of FIG. 2.

In FIG. 4, let it be assumed that the first pinion 48 on the gear shift 44 is in meshing engagement with the first dial drive gear 27, while the second pinion 50 is disengaged from the first idler gear 35. With the gears in this position, the meter is running in the forward direction to cause the input gear 53 to rotate the meter dial (shaft 14) at a normal meter rate determined by the ratio of the input gear 53 and the first dial drive gear 27. It should be noted, that the idler gear assembly 32 rotates with the dial gear drive assembly 10 at this time, but since it is not being driven via the second pinion 50 it merely idles.

Let it now be assumed that the meter is caused to run in the reverse direction by either inverting it or switching the meter blade input leads. Under this condition, the shift plate will now rotate to engage the pinion 50 with the first idler gear 35, while the first pinion 48 is disengaged from the first drive gear 27. As the input drive gear 53 now rotates in the reverse direction, the idler gear assembly 32 (via pinion 50) will rotate to in-turn drive the indicator dials up-scale via the meshing engagement of the second idler gear 36 and the second dial drive gear 28. The rate at which the dials are driven is determined primarily by the gear ratio of the second idler gear 36 on shaft 34 and the second drive gear 28 on shaft 14. This is explained as follows:

It is first significant to note that the gear ratios between the input gear 53 and the first idler gear 35 and the first dial drive gear 27 are preferably the same. As a result, the idler shaft 34, when being driven by pinion 50, will rotate at the same rate as the indicator drive shaft 14 when being driven via the pinion 48. Referring now to FIGS. 3 and 5, it can be seen if gears 28 and 36 have the same number of teeth, that the ratio when gear 35 is being driven via pinion 50 is the same as the ratio when gear 27 is being driven via pinion 48. Thus, the meter dial will be driven up-scale at the same rate, regardless of the direction of rotation of the meter input gear assembly. However, if gears 28 and 36 have different numbers of teeth, the ratios will differ between forward and reverse meter rotation. For example, for a 1:1 gear ratio each of the gears could have 30 teeth. To incorporate a lower gear ratio, of say 2:1, gear 28 would have 40 teeth and gear 36 would have 20 teeth. A 3:1 ratio can be achieved by gear 28 having 45 teeth and gear 36 having 15 teeth. To achieve a 5:1 gear ratio, gear 28 would have 50 teeth and gear 36 would have 10 teeth. Other ratios can be achieved by changing the gear teeth in one tooth increments.

The various above gear ratios (2:1; 3:1; 5:1) would normally be used to penalize those who reverse the direction of meter rotation with an attempt to defraud the utility, by making the meter dial run faster up-scale when the meter is running in the reverse direction.

In one particular type of meter, it was found that 31 teeth on gear 36 and 29 teeth on gear 28 resulted in the ideal gear ratio of 1.0689:1 to compensate for meter drag when the meter was inverted. This compensation, determined through a calibration of the meter running in the upright and inverted positions, provides the proper amount of speed up compensation to make the meter register correctly in either position. In this type of compensation, the abuser is not penalized, but the meter is prevented from slowing down when it is in the inverted position. Thus, the utility is not defrauded of a portion of its revenue due to inversion of the meter.

From the preceding, it can now be seen how a wide range of ratios is possible by merely changing the pitch of the ratio gear assembly comprised of gears 28 and 36. As can be seen from FIG. 2, the ratios can be changed quickly and easily by merely removing two screws 68 and 70 to detach the unidirectional drive assembly back plate 26 and removing the dial indicator 2 by sliding it off of shaft 14. The two gear assemblies 32 and 10 can now be removed by sliding them out of their respective bearing apertures in plates 1 and 20. The replacement or changed gear ratio assemblies can then be inserted in place of those removed and secured in place by reattaching the support member 26, with the gear assembly shafts in place in their respective bearing apertures of support members 1, 20 and 26.

OPERATION OF THE INVENTION

Although the mode of operation of the preferred embodiment of the invention is probably understandable to those skilled in the art from the description of the structure previously presented, the operation will be briefly summarized again. Assuming that the meter register input drive gear 53 is being rotated in a forward direction such that the indicator dial pointer 2 is rotated in an up-scale direction, the input gear assembly 42 will have pivoted the gear shift plate 44 until the stop member 54 reaches one end of its predetermined angular movement and hits the limit stop 58. Thus, the first idler pinion 48 is positioned in a desired degree of meshing engagement with the first indicator drive gear 27 causing it to rotate shaft 14 to move the register indicator up-scale at the normal rate.

Let it now be assumed that input gear 53 is reversed. With this direction of rotation, the frictional forces between the inner wall of hollow shaft 40 and the bearing surfaces of the solid shaft of the gear shift assembly 38 cause the shift plate 44 to rotate in the opposite direction until the stop member 54 reaches the other end of the predetermined range of angular movement and engages the other limit stop 56. The second pinion 50 is now positioned in a desired degree of meshing engagement with the first idler gear 35 causing it it to rotate the idler assembly 32. Rotation of the idler assembly now causes the second idler gear 36 to effect rotation of the second drive gear 28 (with which it is in continuous meshing engagement). Rotation of shaft 14 causes up-scale rotation of the indicator dial 2 at a compensated rate or increased rate (when compared to the rate with forward meter rotation) as determined by the ratio of the second idler gear and the second dial drive gear.

It will be understood by those skilled in the art, that various modifications and alternative arrangements might be made in applying the invention to various applications, thus it is my intent to encompass within the following claims the true spirit and scope of the invention as it relates to such modifications and arrangements.

What I claim as new and desire to secure by Letters Patent of the United States is:

1. In a meter of the type having a gear driven register, a unidirectional drive assembly for driving a register dial on said register comprising:

(a) a frame assembly including supporting members for the retention of gear assemblies rotatably mounted therebetween;

(b) an idler assembly including first and second coaxially mounted idler gears;

(c) a register drive assembly for driving a register dial including, first and second coaxially mounted dial drive gears, with said second dial drive gear being in continuous meshing engagement with said second idler gear;

(d) an input drive assembly capable of being rotated in either of first and second directions, including a coaxially mounted input gear and a gear shift assembly mounted in frictional contact with said input drive assembly for coaxial rotation therewith, said gear shift assembly having first and second rotatably mounted pinions in continuous meshing engagement with said input gear, said first pinion being positioned adjacent said first dial drive gear and said second pinion being positioned adjacent said first idler gear, with the ratios of said input gear, said first dial drive gear and said first idler gear being substantially the same, said gear shift assembly being operable to bring said first pinion into meshing engagement with said first dial drive gear when said input drive assembly is rotated in said first direction to drive said register dial up-scale at a first rate determined by the ratio of said input gear and said first dial drive gear, and further being operable to bring said second pinion into meshing engagement with said first idler gear when said input drive assembly is driven in said second direction to drive said register dial up-scale at a second rate determined by the ratio of said second idler gear and said second dial drive gear.

2. A unidirectional drive assembly as defined in claim 1 wherein the ratio of said second idler gear and said second dial drive gear cause said register dial to be driven up-scale at a faster rate than said first rate.

3. A unidirectional register drive assembly as recited in claim 1 wherein said second rate is substantially the same as said first rate, as determined by the ratio of said second dial drive gear and said second idler gear being lower than the ratio of said input gear and said first dial drive gear to compensate for frictional drag forces exerted on said meter when operating in an inverted position.

4. In a meter of the type having a gear driven register, a unidirectional drive assembly for driving a register dial on said register comprising:

(a) a frame assembly including supporting members for the retention of gear shaft assemblies rotatably mounted therebetween;

(b) an idler shaft assembly including first and second idler gears mounted for coaxial rotation therewith;

(c) a register drive shaft assembly for driving a register dial including first and second dial drive gears mounted for coaxial rotation therewith, said second dial drive gear being in continuous meshing engagement with said second idler gear;

(d) an input drive shaft assembly capable of being rotated in either of first and second directions, said input drive shaft assembly being of hollow shaft construction and including an input gear mounted for coaxial rotation therewith, said input drive shaft assembly further including a gear shift assembly having a shaft inserted in one end thereof into said input drive shaft assembly and forming frictional contact therewith and having solidly attached at the other end, a shift plate including first and second pinions rotably mounted thereon and in continuous meshing engagement with said input gear, said first pinion being positioned adjacent said first dial drive gear and said second pinion being positioned adjacent said first idler gear, with the ratios of said input gear, said first dial drive gear and said first idler gear being substantially the same, said gear shift assembly being operable to bring said first pinion into meshing engagement with said first dial drive gear, when said input drive shaft assembly is rotated in said first direction to drive said register drive shaft assembly and said register dial up-scale at a first rate determined by the ratio of said input gear and said first dial drive gear, and further being operable to bring said second pinion into meshing engagement with said first idler gear when said input drive shaft assembly is driven in said second direction to drive said register dial up-scale at a second rate determined by the ratio of said second idler gear and said second dial drive gear.

5. In a gear driven meter register, an improved unidirectional drive assembly of the type including an indicator drive assembly and an idler gear assembly in continuous meshing engagement for driving a register dial on said indicator gear assembly up-scale in response to the forward and reverse directions of rotation of an input drive gear assembly and a gear shift assembly pivotally co-operating with the rotation of said input drive gear assembly to effect the selective interruptible engagement of first and second idler pinions on the gear shift assembly with said indicator gear drive and idler gear assemblies respectively, said improved unidirectional drive assembly comprising:

(a) first and second dial drive gears mounted on said indicator gear assembly for coaxial rotation therewith, said first dial drive gear being mounted adjacent the first pinion of said gear shift assembly for selectively interruptible engagement with said first dial drive gear;

(b) first and second idler gears mounted on said idler gear assembly for coaxial rotation therewith, said second idler gear being in continuous meshing engagement with said second dial drive gear, and said first idler gear being mounted adjacent the second pinion of said gear shift assembly for selectively interruptible engagement with said first idler gear, the ratios of said input drive gear assembly, said first idler drive gear and said first dial drive gear being substantially the same, with the pinions of said gear shift assembly being in continuous meshing engagement with said input drive gear assembly, whereby said gear shift assembly operates to bring the first pinion into meshing engagement with said first dial drive gear when pivoted by said input drive gear assembly being rotated in a forward direction of rotation to drive said register dial up-scale at a first rate determined by the ratio of said input drive gear assembly and said first dial drive gear, and further operating to bring the second pinion into meshing engagement with said first idler gear when pivoted by said input drive gear assembly being driven in the reverse direction of rotation to drive said register dial up-scale at a second rate determined by the ratio of said second dial drive gear and said second idler gear.

* * * * *